US012326307B2

(12) United States Patent
Roth et al.

(10) Patent No.: US 12,326,307 B2
(45) Date of Patent: Jun. 10, 2025

(54) FIREARM WITH COCKING SAFETY LEVER

(71) Applicant: ISRAEL WEAPON INDUSTRIES (I.W.I) LTD., Ramat HaSharon (IL)

(72) Inventors: Assaf Roth, Hod Hasharon (IL); Doron Erez, Holon (IL)

(73) Assignee: ISRAEL WEAPON INDUSTRIES (I.W.I) LTD., Ramat HaSharon (IL)

( * ) Notice: Subject to any disclaimer, the term of this patent is extended or adjusted under 35 U.S.C. 154(b) by 17 days.

(21) Appl. No.: 18/413,082

(22) Filed: Jan. 16, 2024

(65) Prior Publication Data

US 2024/0247898 A1 Jul. 25, 2024

(30) Foreign Application Priority Data

Jan. 25, 2023 (IL) ..... 300188

(51) Int. Cl.
*F41A 17/06* (2006.01)

(52) U.S. Cl.
CPC ..... *F41A 17/06* (2013.01)

(58) Field of Classification Search
CPC ..... F41A 17/06
USPC ..... 42/70.01
See application file for complete search history.

(56) References Cited

U.S. PATENT DOCUMENTS

| | | | | |
|---|---|---|---|---|
| 4,329,803 | A | 5/1982 | Johnson et al. | |
| 4,727,670 | A | 3/1988 | Krouse | |
| 5,713,150 | A | 2/1998 | Ealovega | |
| 8,336,438 | B2 | 12/2012 | Compton et al. | |
| 8,549,780 | B2 | 10/2013 | Emde et al. | |
| 10,309,743 | B2 | 6/2019 | Rami | |
| 10,845,148 | B2 | 11/2020 | Shneorson et al. | |
| 2004/0020094 | A1 | 2/2004 | Ealovega | |
| 2005/0257676 | A1 | 11/2005 | Ealovega | |
| 2016/0084601 | A1 | 3/2016 | Alicea, Jr. et al. | |
| 2018/0224231 | A1 | 8/2018 | Weinberg | |
| 2019/0346226 | A1 | 11/2019 | Shneorson et al. | |
| 2020/0340771 | A1 | 10/2020 | Shneorson et al. | |
| 2022/0307789 | A1* | 9/2022 | Kloepfer | F41A 17/066 |
| 2022/0319258 | A1* | 10/2022 | Kloepfer | G07C 9/29 |
| 2022/0333888 | A1* | 10/2022 | Kloepfer | F41A 19/59 |
| 2024/0247898 | A1* | 7/2024 | Roth | F41A 19/59 |

* cited by examiner

*Primary Examiner* — Samir Abdosh
(74) *Attorney, Agent, or Firm* — SOROKER AGMON NORDMAN RIBA

(57) ABSTRACT

A firearm, including a hammer, a safety lever configured to select an operation mode, a trigger, an electromechanical sear, wherein the operation modes include an electromechanical mode, and the firearm is configured so that when changing to the electromechanical mode the safety lever moves the position of the hammer to be held by the electromechanical sear instead of by the trigger. Likewise when changing the operation mode from the electromechanical mode to other modes the safety lever moves the position of the hammer so that the hammer. is released from the electromechanical sear and held by the trigger.

15 Claims, 17 Drawing Sheets

FIREARM WITH COCKING SAFETY LEVER

FIELD OF THE DISCLOSURE

The present disclosure relates to a firearm that supports an electromechanical firing system and a mechanical firing system, and more specifically wherein the firearm includes a safety lever that is configured to select between use of the electromechanical firing system and the mechanical firing system.

BACKGROUND OF THE DISCLOSURE

In the past, firearms were generally built with mechanical systems for releasing bullets. The mechanical systems typically supported various mode of operation, usually three or four modes, for example:

1. A safe mode that prevents the release of bullets;
2. A semi-automatic mode that releases a single bullet every time the user pulls the trigger;
3. A burst mode that releases multiple bullets (e.g., 3 or 4 bullets) every time the user pulls the trigger; and
4. An automatic mode that continuously releases bullets while the trigger is held.

Generally, the firearm includes a safety lever to select the mode of operation of the firearm.

In recent years some firearms are equipped with a computerized mode, in which a computer uses sensors to evaluate the environment and electronically release bullets based on decisions of the computer, while the trigger is held. Firearms that support computerized modes generally require the use of an electrical power source for the function of all modes.

The current disclosure describes a firearm that can function in mechanical modes and in a computerized mode using the mechanical safety lever to actively switch between modes.

SUMMARY OF THE DISCLOSURE

An aspect of an embodiment of the disclosure, relates to a firearm with a hammer, a trigger, an electromechanical sear and a safety lever configured to select an operation mode. The modes include an electromechanical mode and when the user rotates the safety lever to select the electromechanical mode the position of the hammer is adjusted by a small force applied by the safety lever to move the hammer to be held by the electromechanical sear instead of by the trigger. Optionally, the firearm may also have a mechanical sear to function as a standard firearm without electrical power. When a mechanical mode is selected the mechanical sear or the trigger controls release of the hammer. When the electromechanical mode is selected the electromechanical sear controls release of the hammer according to the decision of a computer or controller, as long as the trigger is engaged.

In an embodiment of the disclosure, when the user rotates the safety lever from the electromechanical mode to the mechanical mode the hammer is moved to be released from the electromechanical sear and to be held by at least one mechanical sear or by the trigger.

When the hammer is in mechanical mode pressing the trigger releases an immediate fire. When the hammer is moved by the safety lever to the electromechanical position in electromechanical mode, pressing the trigger just starts a computerized sequence and when the computer decides to fire (and the trigger is pressed) the computer signals to an electromechanical firing control (EMFC) to operate the electromechanical sear to release the trigger to fire.

There is thus provided according to an embodiment of the disclosure, a firearm, comprising:

a hammer;

a safety lever configured to select an operation mode;

a trigger;

an electromechanical sear;

wherein the operation modes include an electromechanical mode, and the firearm is configured so that when moving the safety lever to select the electromechanical mode the safety lever moves the position of the hammer to be held by the electromechanical sear instead of by the trigger.

In an embodiment of the disclosure, the firearm is configured so that when changing the operation mode from the electromechanical mode to other modes the safety lever moves the position of the hammer so that the hammer is released from the electromechanical sear and held by the trigger. Optionally, the electromechanical mode is in addition to supporting mechanical modes that function without electrical power. In an embodiment of the disclosure, the safety lever is configured to move the position of the hammer with a set of levers; wherein the set of levers are coupled to the safety lever, the hammer and/or a hammer cocking sear. Optionally, the firearm comprises a hammer cocking sear; wherein the hammer cocking sear includes a head lever and a tail lever; and wherein when moving the safety lever to the electromechanical mode, the safety lever pushes the tail lever of the hammer cocking sear and causes the head lever to lower the hammer to be held by the electromechanical sear instead of by the trigger.

In an embodiment of the disclosure, the firearm comprises an automatic mode sear that regulates firing in automatic mode; and wherein the automatic mode sear is coupled to the hammer cocking sear. Optionally, the hammer includes an extrusion lever configured to be pushed by the head lever of the hammer cocking sear to lower the hammer. In an embodiment of the disclosure, the safety lever includes a bulge lever configured to push the tail lever of the hammer cocking sear when changing to or from the electromechanical mode. Optionally, the firearm comprises a semi-auto sear configured to hold the hammer immediately after releasing a first shot manually in a semi-automatic mode; and wherein the semi-auto sear is positioned in parallel to the electromechanical sear.

In an embodiment of the disclosure, the safety lever is configured to block motion of the electromechanical sear when not in use. Optionally, the firearm comprises an electromechanical firing control (EMFC) configured to store mechanical energy and release shots responsive to decisions of a computer.

There is further provided according to an embodiment of the disclosure, a method of activating a firearm in an electromechanical mode, comprising:

receiving a firearm comprising a hammer, a safety lever, a trigger and an electromechanical sear;

moving the safety lever to select an electromechanical mode;

wherein when moving the safety lever to select the electromechanical mode the safety lever moves the position of the hammer to be held by the electromechanical sear instead of by the trigger. In an embodiment of the disclosure, the firearm is configured so that when changing the operation mode from the electromechanical mode to other modes the safety lever moves the position of the hammer so that the hammer is released from the electromechanical sear and held by the trigger. Optionally, the safety lever moves the position of the hammer with a set of levers; wherein the set of levers are coupled to the safety lever, the hammer and/or a hammer cocking sear. In an embodiment of the disclosure, the firearm comprises a hammer cocking sear; wherein the hammer cocking sear includes a head lever and a tail lever; and wherein when moving the safety lever to the electromechanical mode, the safety lever pushes the tail lever of the hammer cocking sear and causes the head lever to lower the hammer to be held by the electromechanical sear instead of by the trigger.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
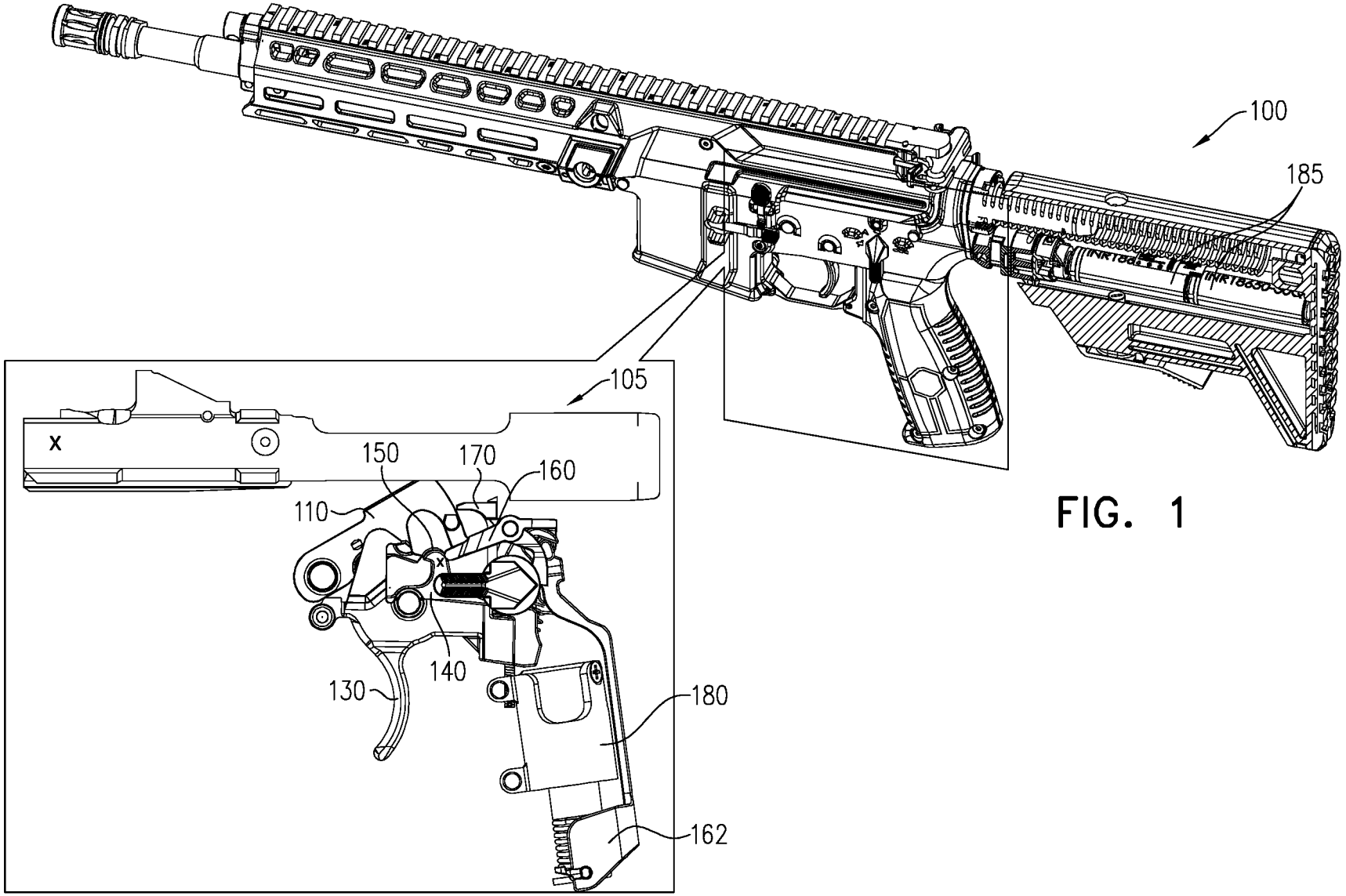
FIG. 1 is a schematic illustration of a firearm and a trigger assembly, according to an embodiment of the disclosure.
Figure 2:
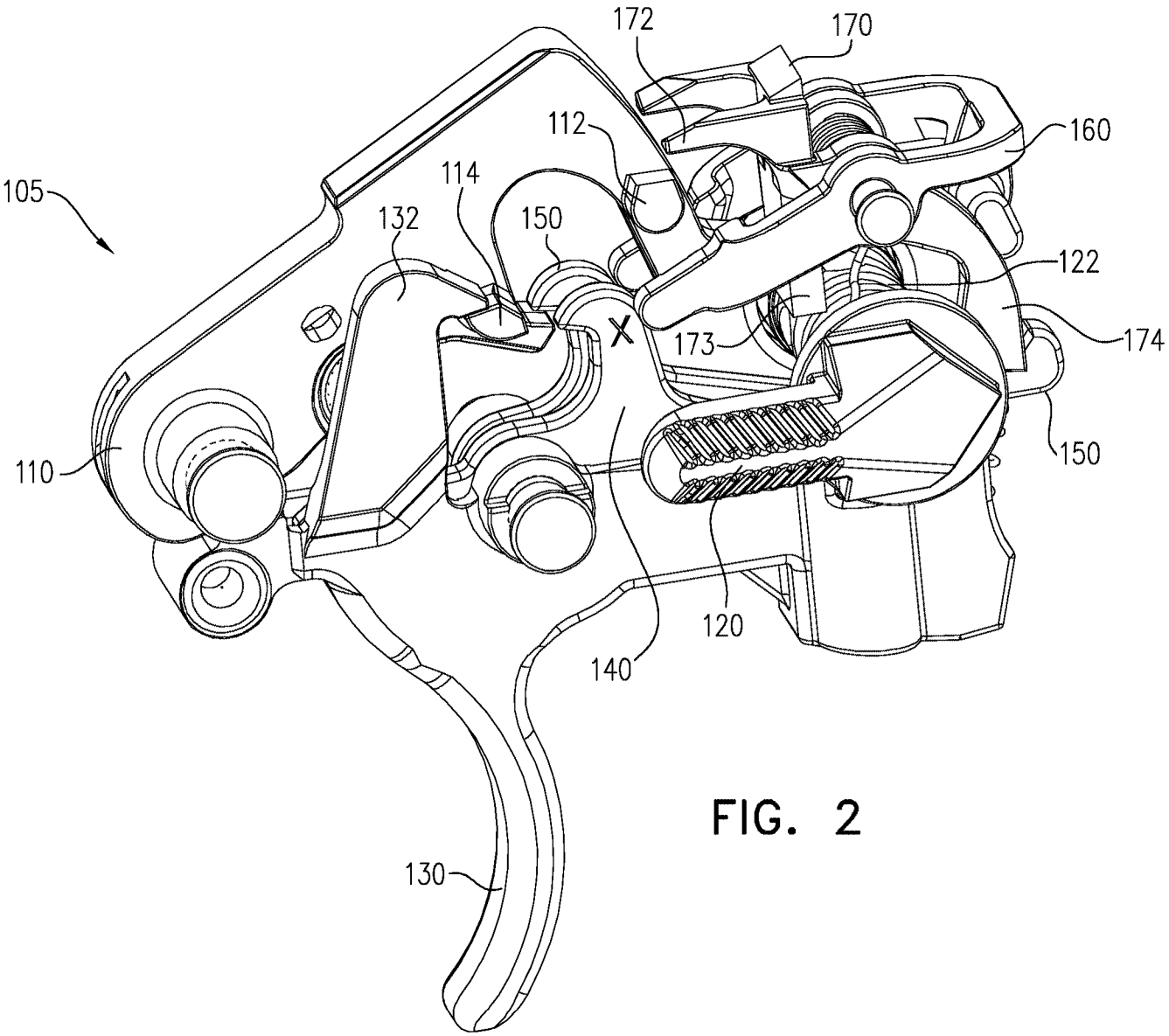
FIG. 2 is a schematic illustration of a perspective view of a trigger assembly, according to an embodiment of the disclosure.

FIG. 1 is a schematic illustration of a firearm 100 and a trigger assembly 105, and FIG. 2 is a schematic illustration of a perspective view of a trigger assembly, according to an embodiment of the disclosure. In an embodiment of the disclosure, the firearm 100 is configured to function in manual mode, for example supporting a safe mode, a semi-automatic mode and an automatic mode. Additionally, the firearm 100 is configured to function in an electromechanical (EM)/computerized mode, wherein an electromechanical firing controller (EMFC) 180 uses a computer to control the release of shots. For example, the EMFC 180 may control the release of shots based on analysis of measurements from local or remote sensors, as described in U.S. Pat. No. 10,845,148, the disclosure of which is incorporated by reference in its entirety. Optionally, in the manual modes (e.g., safe, semi-automatic and automatic) the firearm functions without requiring an electrical power source 185. However in the EM/computerized mode, a power source 185 is required to control the release of bullets or other projectiles.

In an embodiment of the disclosure, the trigger assembly 105 may include the following elements:

1. A hammer 110 configured to release a shot;
2. A safety lever 120 configured to select operation modes and cock the hammer when moving to or from the electromechanical (EM) mode;
3. A trigger 130, which may be engaged/pulled or disengaged/released;
4. A semi-auto sear 140, which may be referred to also as a disconnector (marked in the figures with an X), and is configured to hold the hammer after firing a shot in semi-automatic mode;
5. An electromechanical (EM) sear 150 configured to hold or release the hammer 110 when functioning in the EM mode, this mode can be referred to as a computerized mode, for releasing bullets responsive to instructions from a computer. Optionally, the EM sear 150 is positioned in parallel to the semi-auto sear 140 if both are included in the firearm 100;
6. An electromechanical firing controller (EMFC) cocking element 160 that is configured to cock the electromechanical firing controller 180 (see below) when the hammer 110 rebounds from firing a shot or by manual cocking of the firearm;
7. A Sear Lever 162 configured to transfer the motion of the EMFC cocking element 160 to the EMFC 180 (see below) and press on the EM sear 150 when the EMFC 180 is operated for fire command;
8. An automatic mode sear 173 that is configured to regulate firing in automatic mode and to cock the hammer 110 when moving the safety lever to or from the EM mode;
9. A hammer cocking sear 170 that is configured to cock the hammer 110 when moving the safety lever to or from the EM mode, the hammer cocking sear may be integrated with automatic mode sear 173 or be a separate sear.
10. An electromechanical firing controller (EMFC) 180 configured to store mechanical energy and release shots responsive to decisions of a computer (e.g., a general processor, DSP, FPGA or ASIC) that analyzes measurements from sensors, which may be installed within the firearm or that communicate with the firearm.

In an embodiment of the disclosure, transition between the different modes is performed with safety lever 120. When changing to EM mode the safety lever 120 is rotated and moves the hammer cocking sear 170 to cock the hammer 110 so that it is held by EM sear 150. Optionally, to release a shot, (when the trigger 130 is pressed or engaged) EMFC 180 releases the stored mechanical energy by releasing the sear lever 162 that pulls downward on an end of EM sear 150 and releases the grasp of EM sear 150 from the hammer 110. The hammer 110 then flies forward and releases a shot. In an embodiment of the disclosure, trigger 130 includes a hooked end 132 that is configured to hold an extrusion 114 from hammer 110. This serves to prevent accidental release of a shot if the trigger 130 is not engaged or releasing a mechanical shot when the safety lever 120 is in semi-auto or automatic position.

Figure 3A:
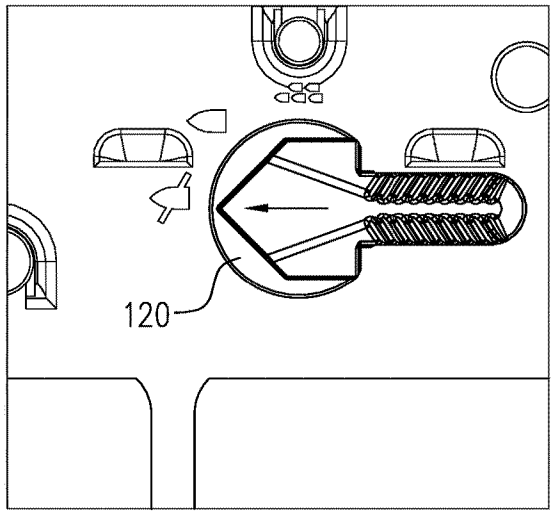
FIGS. 3A-3D are schematic illustrations of safety lever settings, according to an embodiment of the disclosure.
Figure 3B:
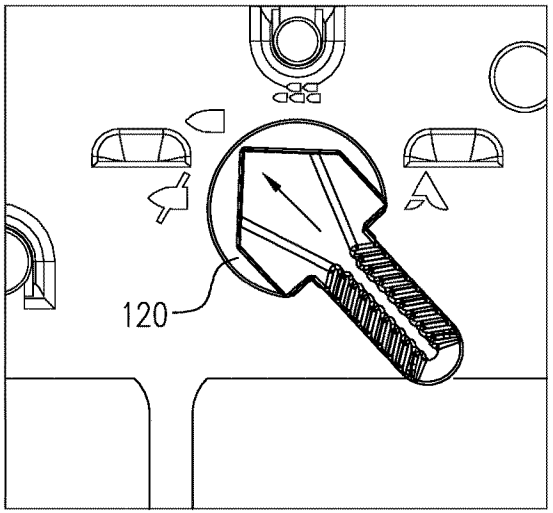
Figure 3C:
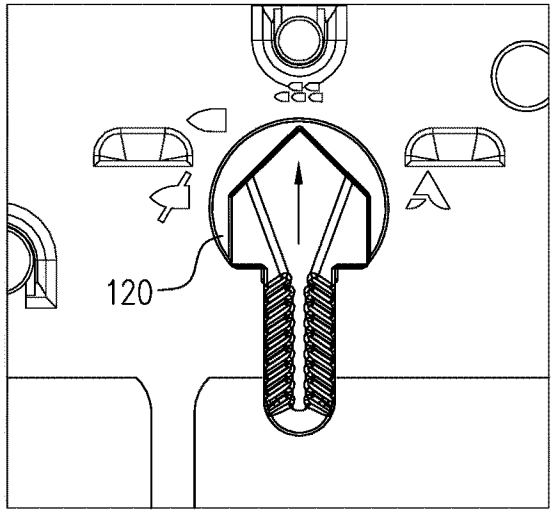
Figure 3D:
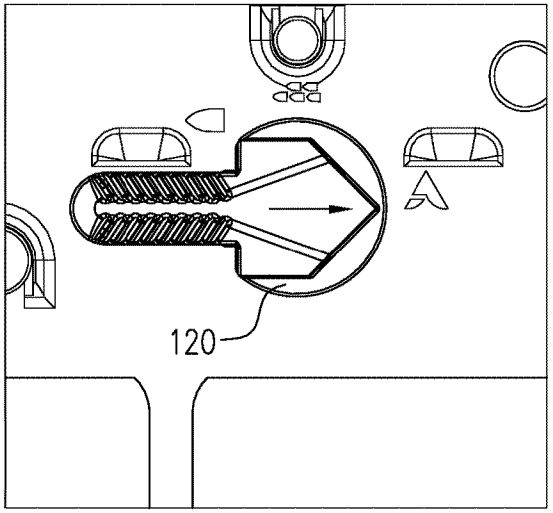

FIG. 3A-3D are schematic illustrations of safety lever 120 settings, according to an embodiment of the disclosure. FIG. 3A shows the position of the safety lever 120, when the firearm 100 is in safe mode, FIG. 3B shows the position of the safety lever after being rotated, for example by 45 degrees clockwise to a semi-automatic mode position. FIG. 3C shows the position of the safety lever after being rotated, for example by 90 degrees from the safe position to an automatic fire mode position; and FIG. 3D shows the safety lever after being rotated for example by 180 degrees from the safe position to an EM mode position. Optionally, the angle of rotation from the automatic firing mode position to the EM mode position is larger (e.g. 90 degrees) than from safe mode to semi-automatic mode or from semi-automatic mode to automatic mode, since this transition is more complicated and requires more leverage to move the hammer 110 downward with the help of the hammer cocking sear 170, against force of a spring 115 (see FIG. 4D) that enables the hammer motion to fire firearm 100.

In an embodiment of the disclosure, hammer cocking sear 170 comprises 3 ends. One serves as an automatic mode sear 173 to regulate firing in automatic mode. One serves as a hammer cocking lever 172 to cock the hammer 110, and one serves as a tail lever 174 to enable the safety lever 120 to push the hammer cocking sear 170. Optionally, hammer cocking sear 170 is formed as a solid unit including hammer cocking lever 172, automatic sear 173 and tail lever 174. Alternatively, hammer cocking lever 172, automatic sear 173 and/or tail lever 174 may be separate elements that are coupled together. In some embodiments of the disclosure, the firearm 100 does not support an automatic mode and the end serving as automatic sear 173 is omitted.

In an embodiment of the disclosure, as shown for example in FIG. 2 the safety lever 120 is coupled to an essentially cylindrical element 122 that rotates with the safety lever 120. The essentially cylindrical element 122 is formed with crevices and extrusions along an elongated axis of the essentially cylindrical element 122. The crevices and extrusions enable or disable movement of the trigger 130, the semi-auto sear/disconnector 140, the EM sear 150 and the automatic mode sear 173 to rise or sink so they are positioned correctly as needed to perform their task, for example to be out of the way or be engaged to act on the hammer 110.

Figure 4A:
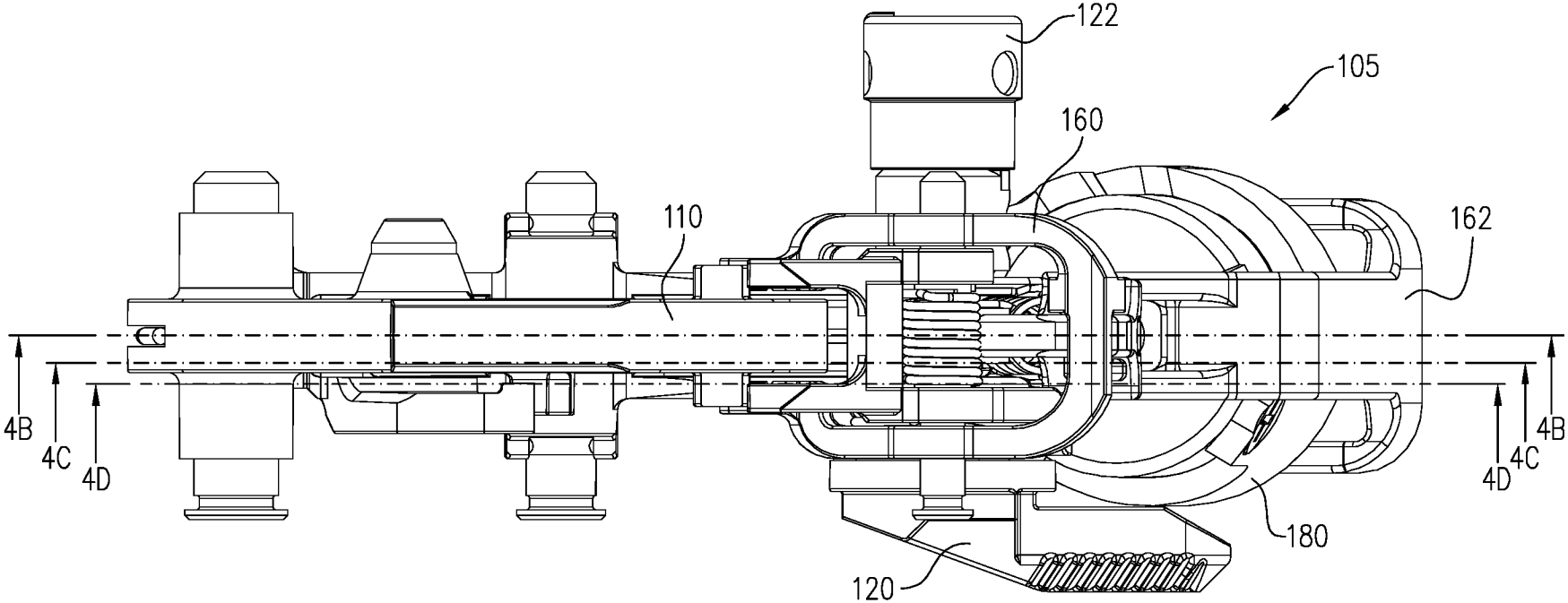
FIGS. 4A-4D are schematic illustrations of a trigger assembly in safe mode, according to an embodiment of the disclosure.
Figure 4B:
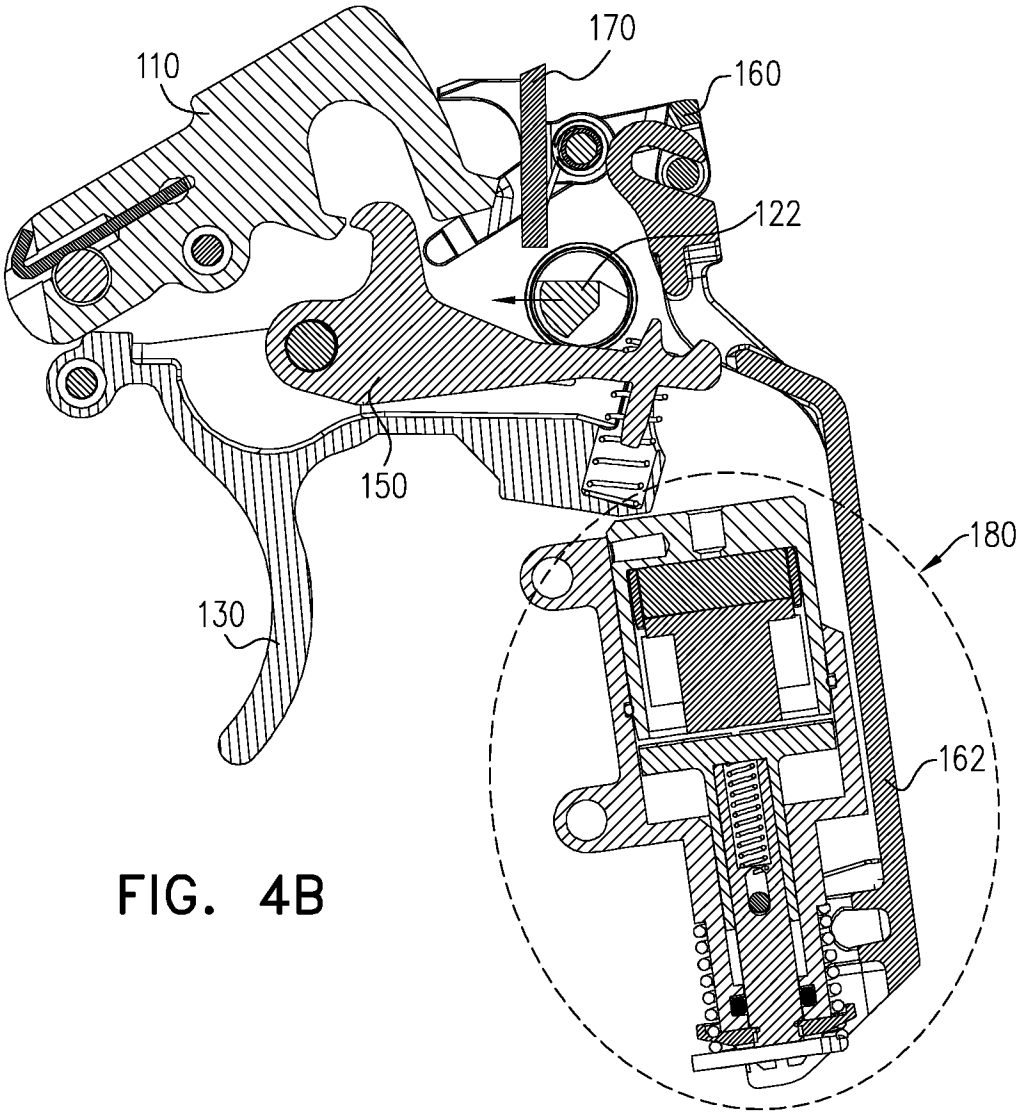
Figure 4C:
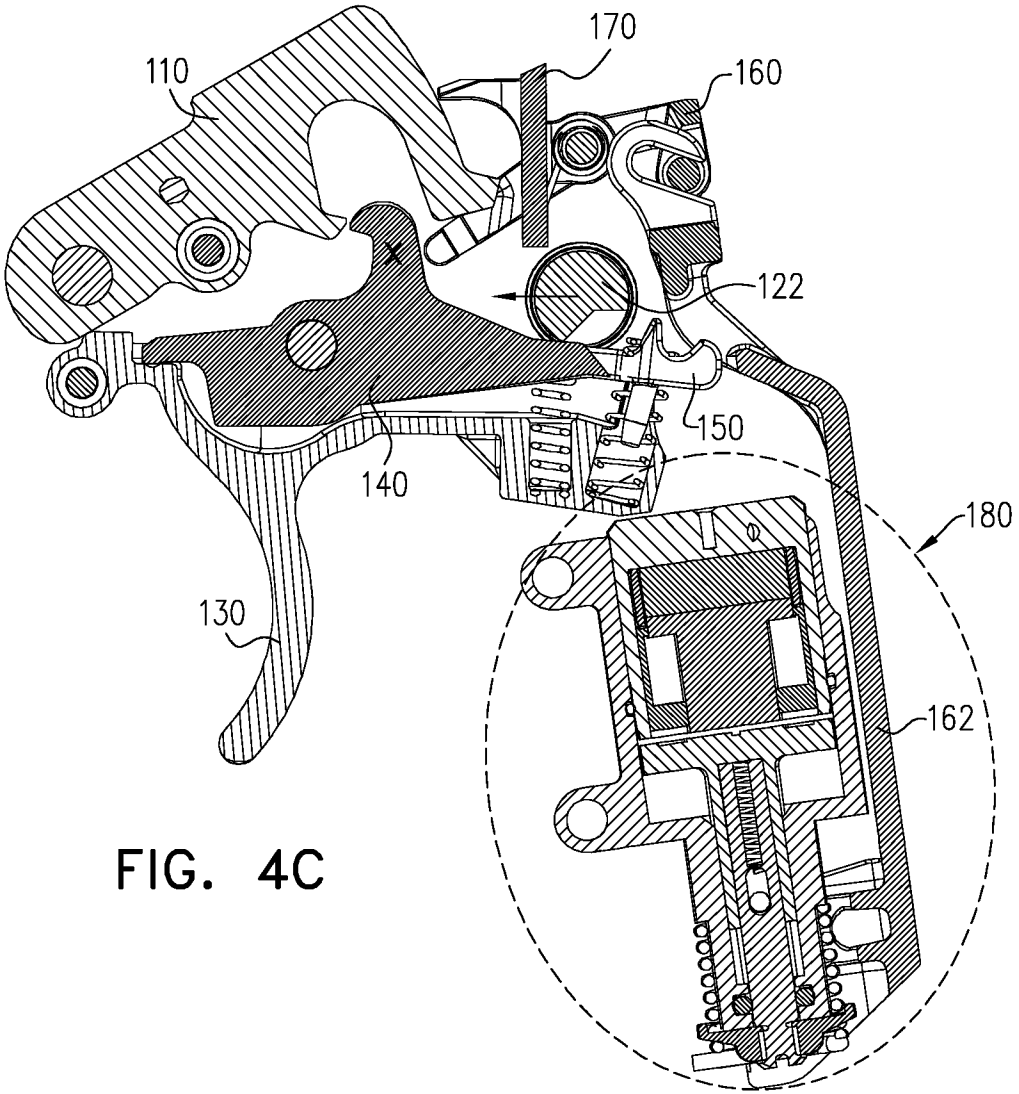
Figure 4D:
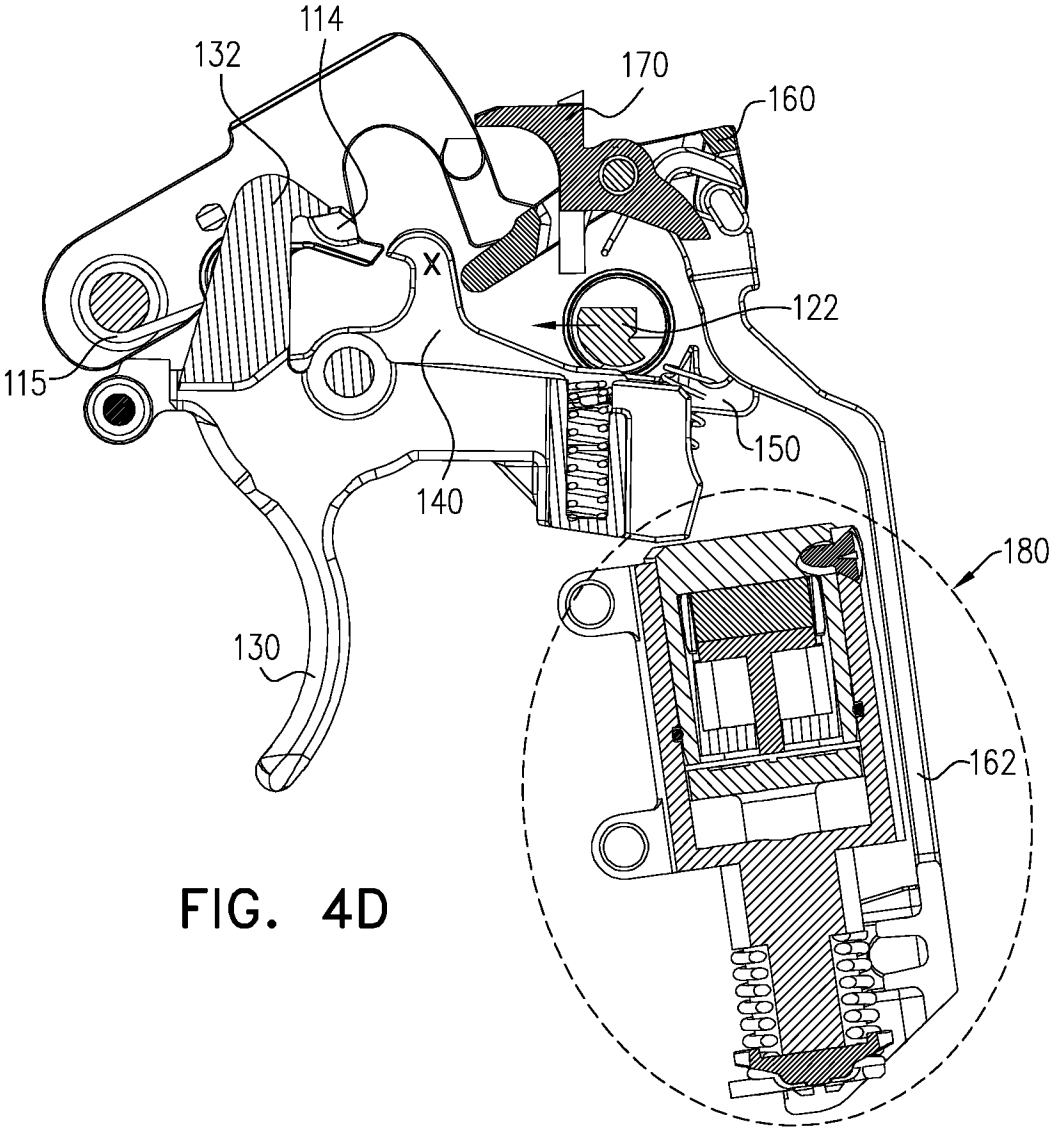

FIGS. 4A-4D are schematic illustrations of a trigger assembly 105 in safe mode, according to an embodiment of the disclosure. FIG. 4A is a top view showing three cross sectional views; FIG. 4B shows a first cross sectional view demonstrating an unengaged EM sear 150; FIG. 4C shows a second cross sectional view demonstrating an unengaged semi-auto sear/disconnector 140; and FIG. 4D shows a third cross sectional view of a released/unpulled/not engaged trigger 130 holding the hammer 110. In an embodiment of the disclosure, in safe mode the safety lever 120 and the cylindrical element 122 coupled to safety lever 120, block the trigger 130 and the EM sear 150 from moving, thus preventing manual and computerized firing.

Figure 5:
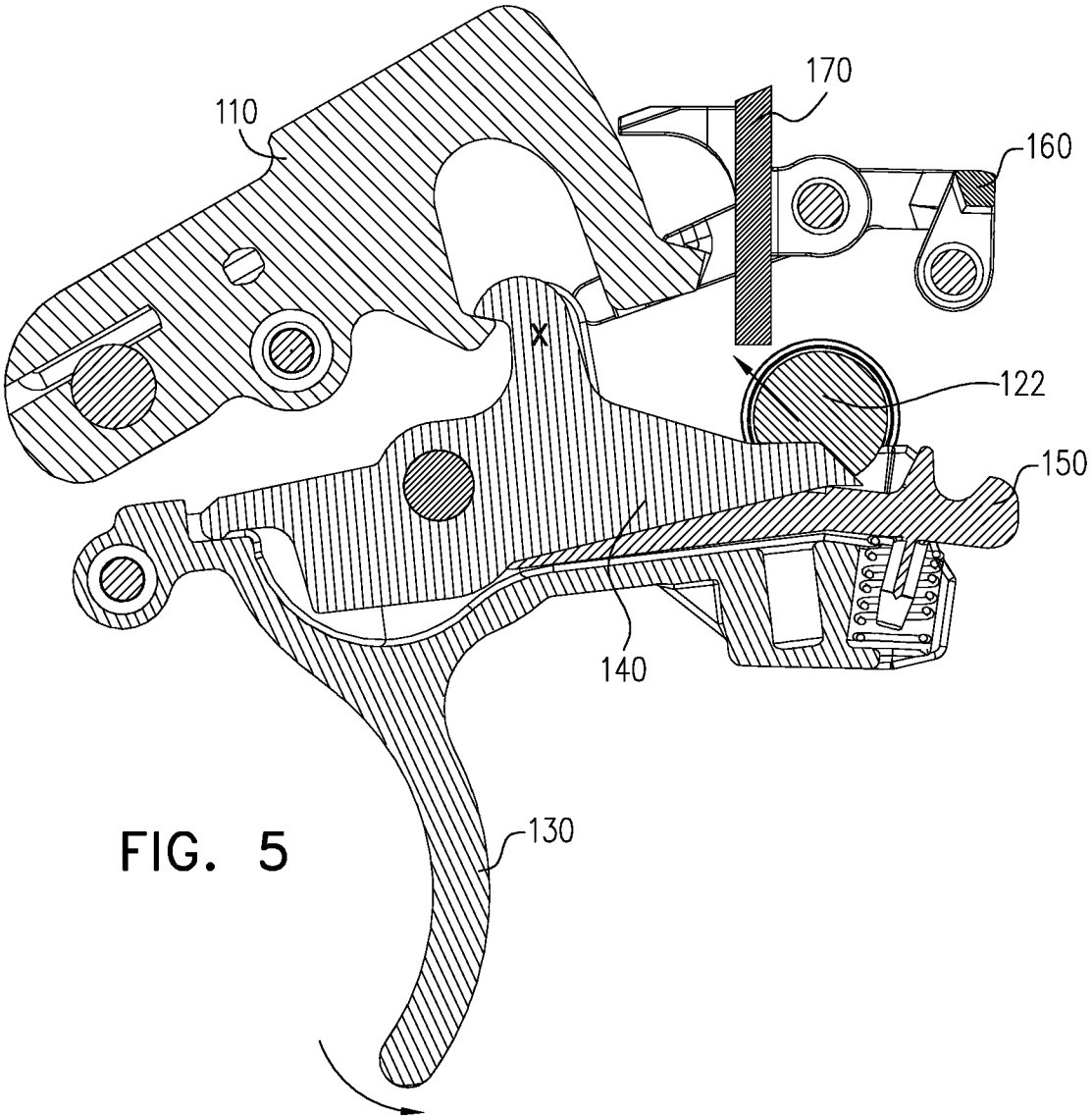
FIG. 5 is a schematic illustration of a cross sectional view of a semi-auto sear/disconnector in semi-automatic mode, according to an embodiment of the disclosure.

FIG. 5 is a schematic illustration of a cross sectional view of a semi-auto sear/disconnector 140 in semi-automatic mode, according to an embodiment of the disclosure. In semi-automatic mode the safety lever allows motion of the trigger 130, blocks motion of the EM sear 150 and allows motion of the semi-auto sear/disconnector 140. This enables the semi-auto sear/disconnector 140 to hold the hammer 110 after firing a first shot to prevent a second shot until the user releases the trigger 130 and then pulls it again.

Figure 6:
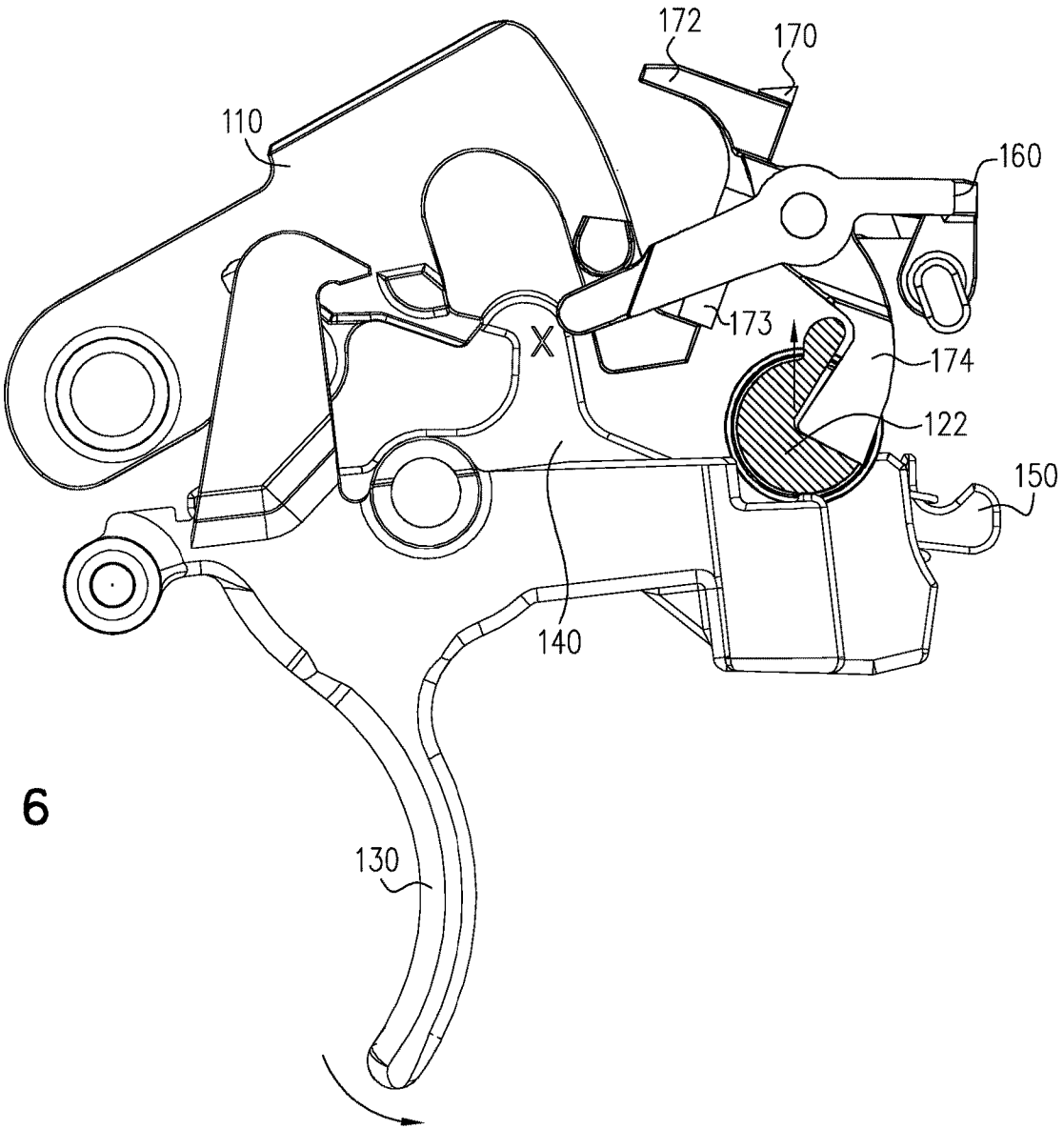
FIG. 6 is a schematic illustration of a cross sectional view of an automatic mode sear in automatic mode, according to an embodiment of the disclosure.

FIG. 6 is a schematic illustration of a cross sectional view of an automatic mode sear 173 in automatic mode, according to an embodiment of the disclosure. In automatic mode when the trigger 130 is engaged, the safety lever 120 allows motion of the trigger 130, locks motion of the EM sear 150, locks motion of the semi-auto sear/disconnector 140 and allows motion of the automatic mode sear 173 to delay release of another bullet until the firearm bolt returns loading another bullet and releasing the automatic mode sear 173 from blocking motion of the hammer 110 to enable the next shot.

Figure 7A:
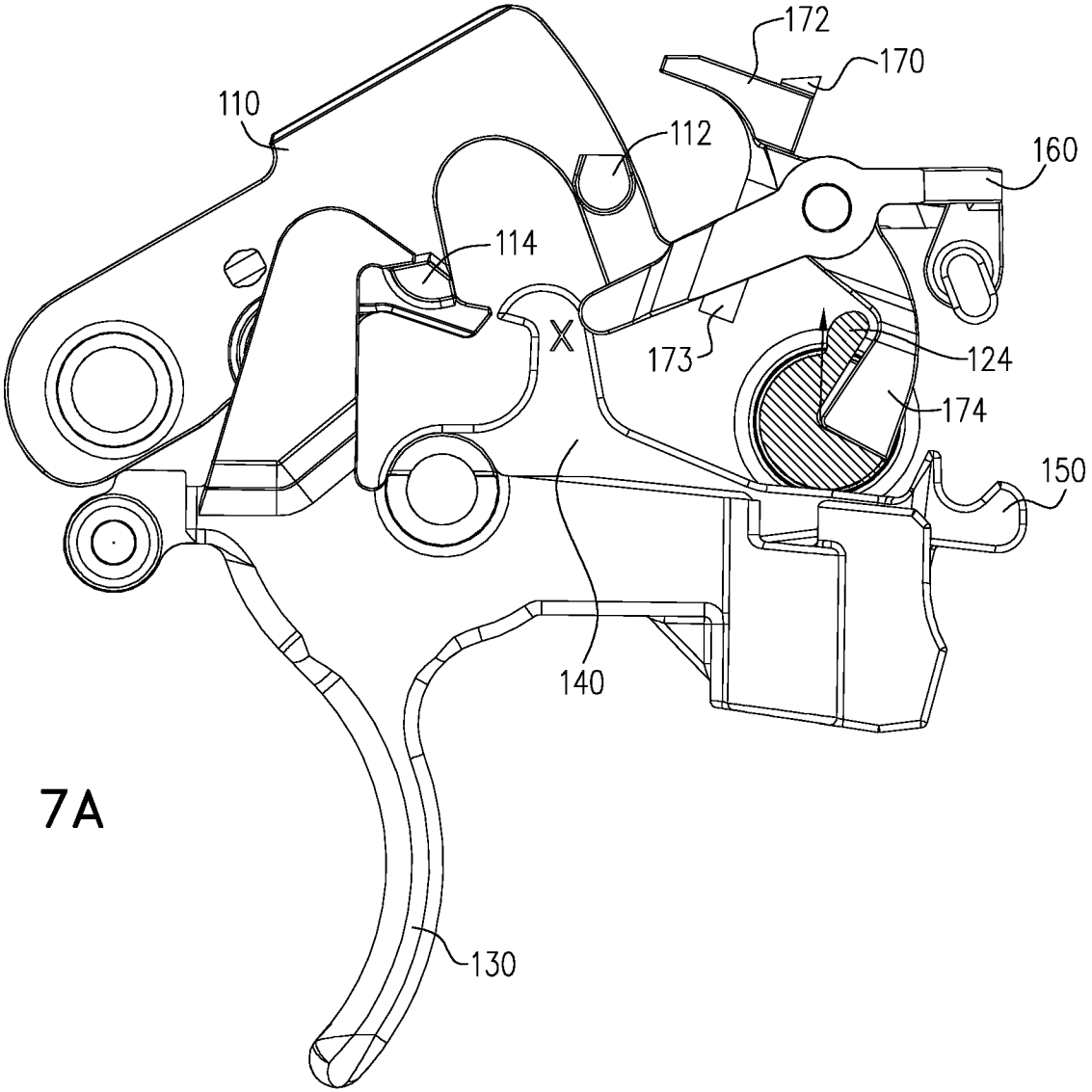
FIGS. 7A-7H are schematic illustrations of a transition from automatic mode to EM mode and vice versa, according to an embodiment of the disclosure.

FIGS. 7A-7F are schematic illustrations of a transition from automatic mode to EM mode and vice versa, according to an embodiment of the disclosure. In contrast to the manual transitions described above, which only require blocking or enabling the movement of sears, in this transition a force is required to lower the hammer 110 against the hammer spring 115 (FIG. 4D) so that it will be held by the EM sear 150 instead of by the trigger 130. When the hammer 110 is held by the EM sear 150 the trigger 130 acts as a safety block device and not as the main shooting mechanism. Lowering the hammer 110 against the hammer spring 115 is achieved by a system of levers that are added to the safety lever 120 and to the hammer cocking sear 170 to enable cocking the hammer 110 by applying a moderate force by the user on the safety lever 120. Initially the hammer 110 is held by the trigger 130, which prevents release of a shot. As shown in FIG. 7A the following levers are added to allow the transition:

1. A bulge lever 124 on the safety lever 120 to push the hammer cocking sear 170;
2. A tail lever 174 that extends from a side of the hammer cocking sear 170 to be pushed by the bulge lever 124 and cause the hammer cocking sear 170 to turn;
3. A head lever 172 that protrudes from a top end of the hammer cocking sear 170 that will turn with the hammer cocking sear 170 and push the hammer 110 downward;
4. An extrusion lever 112 on the hammer to be pushed by the head lever 172 of hammer cocking sear 170; Extrusion lever 112 may also serve to press lever 160 and cock the EMFC 180.

Figure 7B:
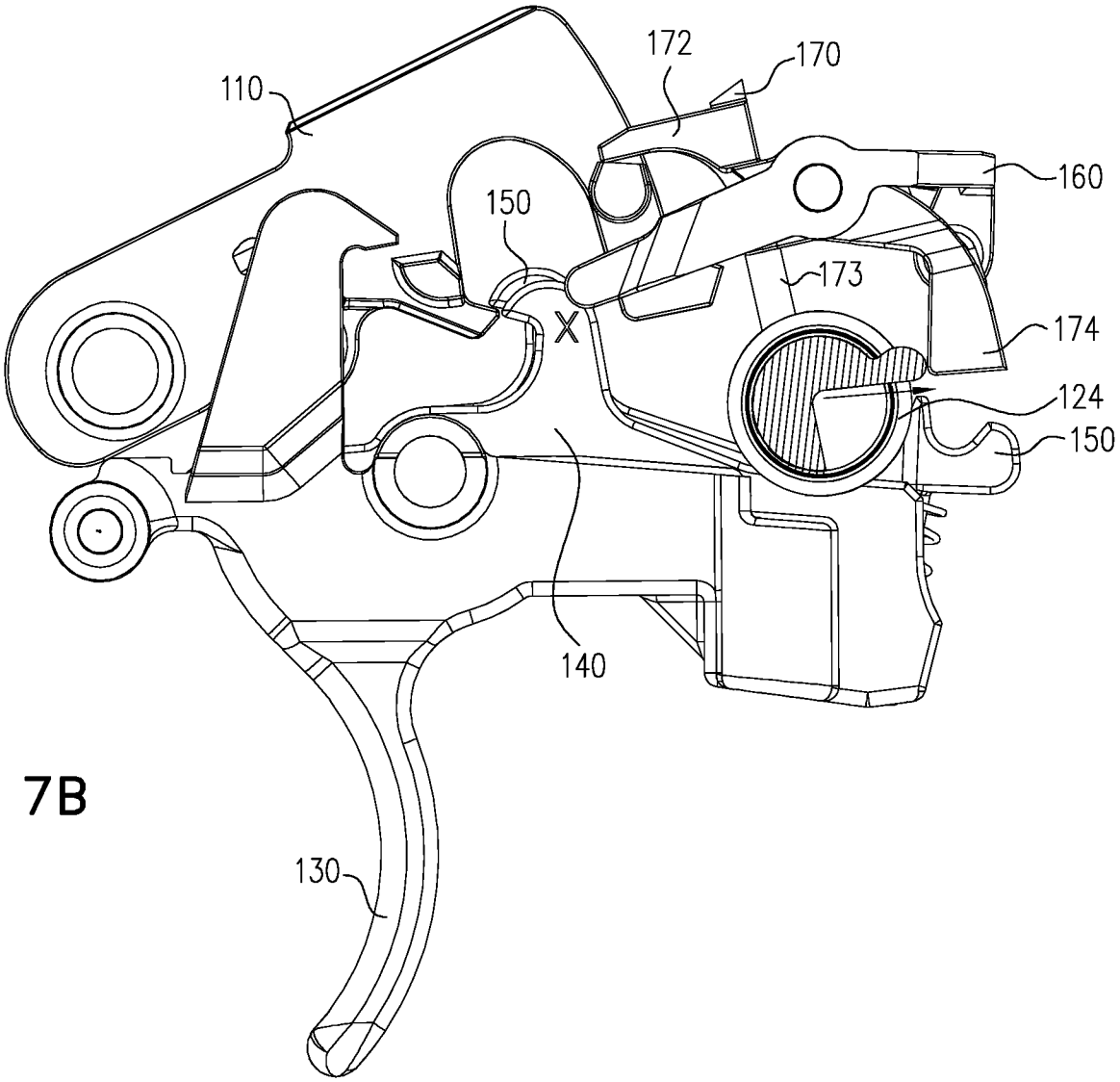
Figure 7C:
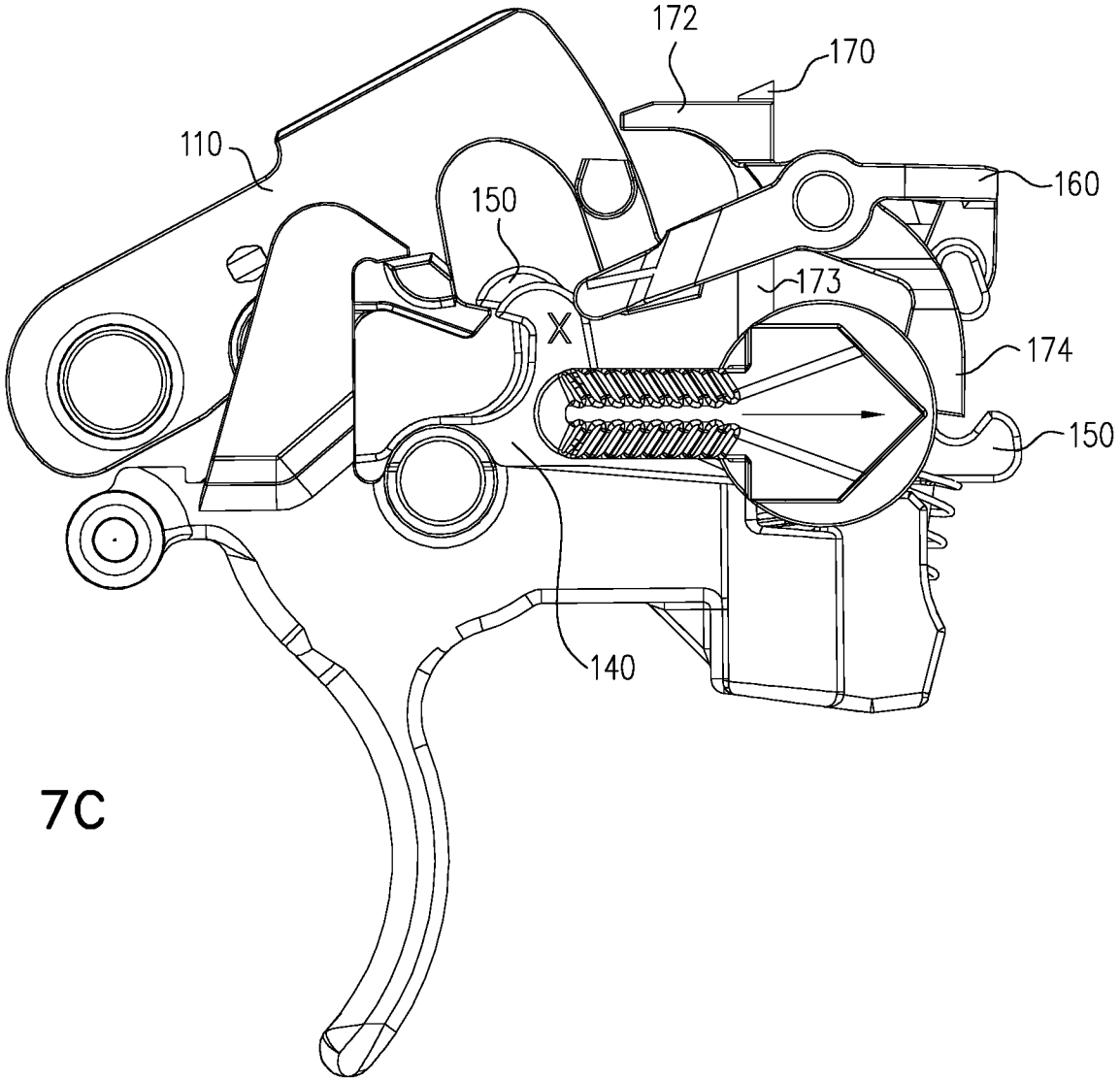
Figure 7D:
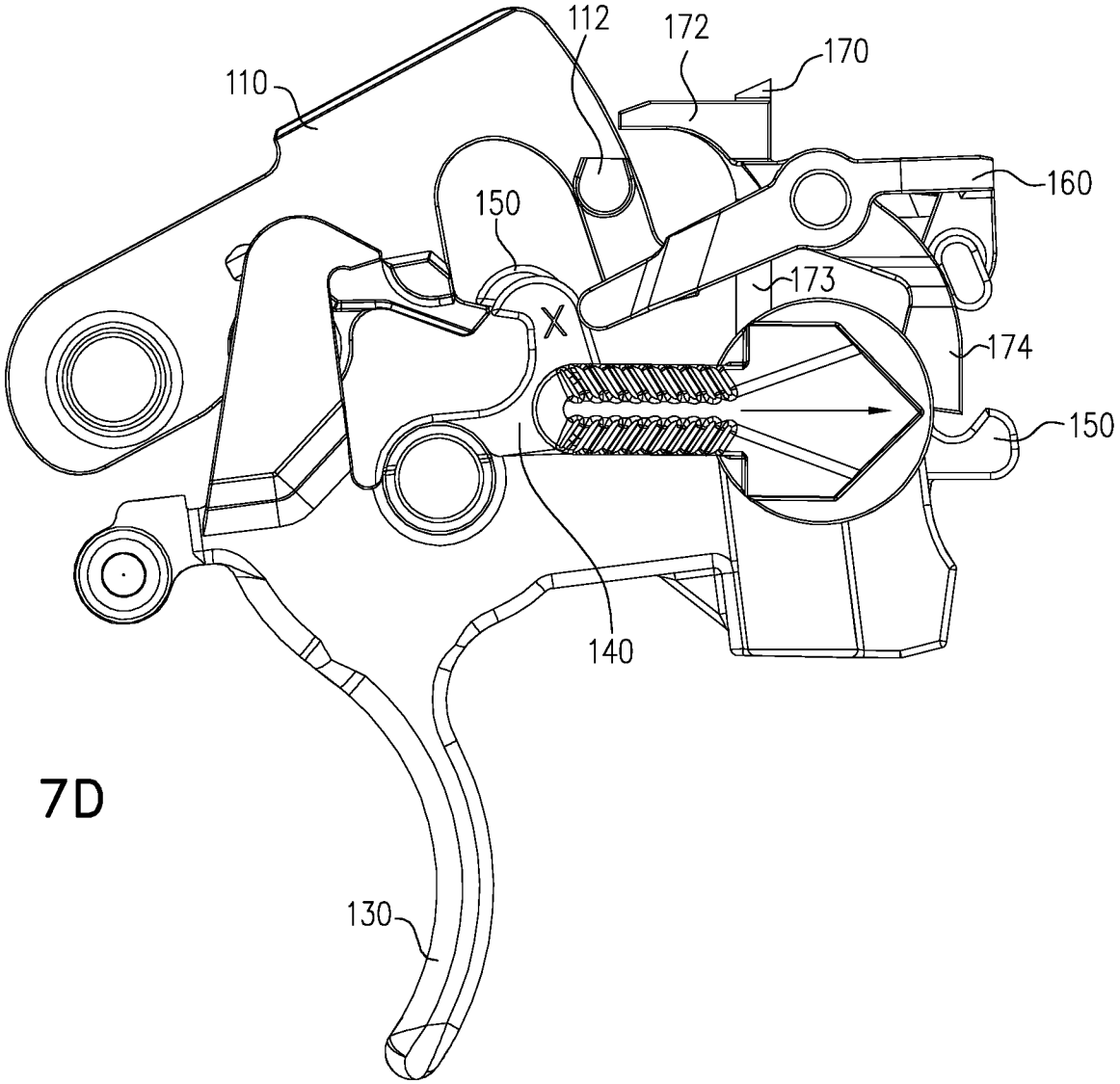
Figure 7E:
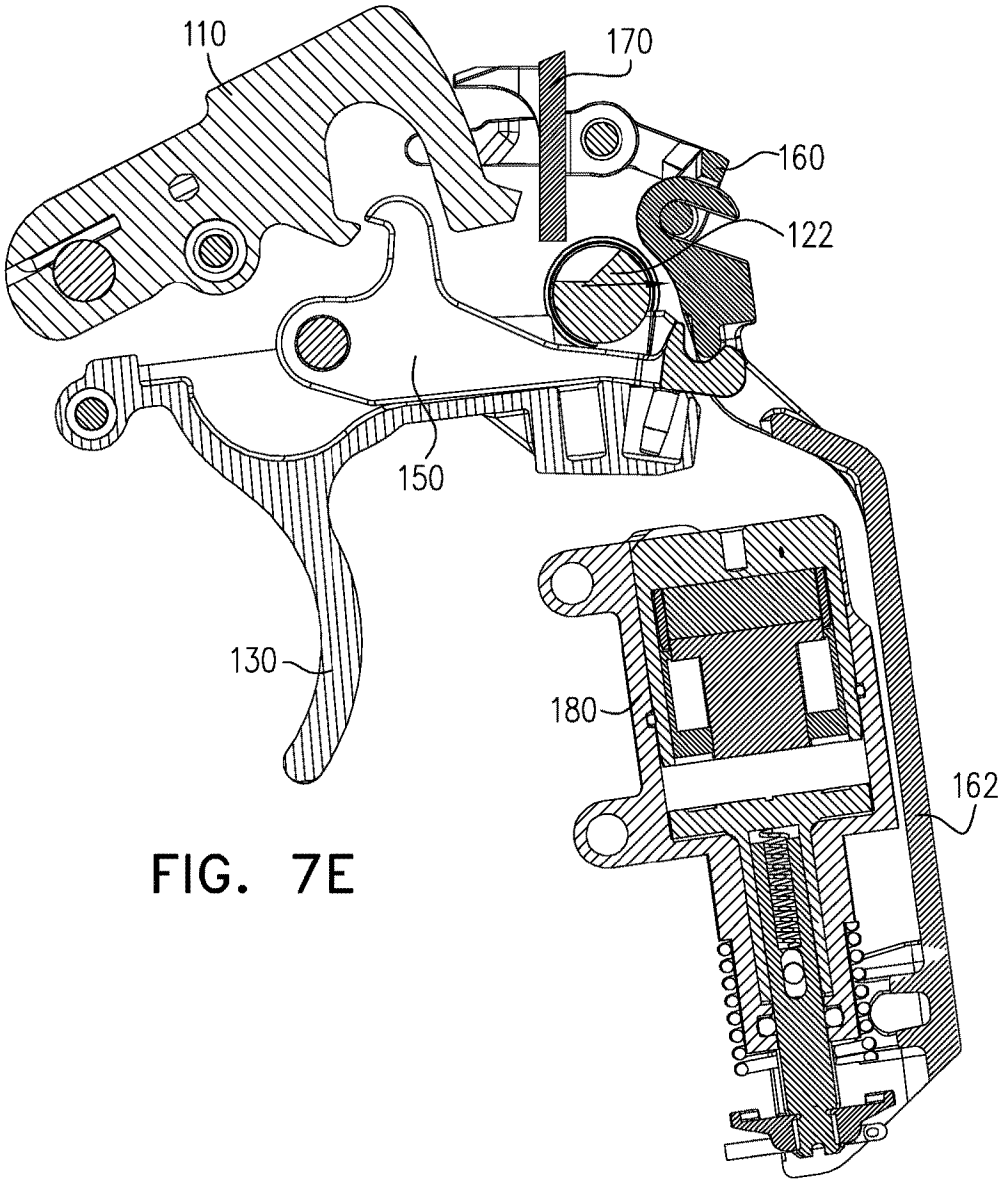

As shown by FIGS. 7A-7C the hammer cocking sear 170 pushes the hammer 110 downward, so that it will be held by the EM sear 150 instead of by the trigger 130 (FIG. 7C). Pulling the trigger (FIG. 7D) removes the trigger 130 from serving as a backup block for the hammer 110. Once the trigger 130 is engaged the hammer 110 is controlled only by the EM sear 150. In an embodiment of the disclosure, when the safety lever 120 is moved to EM mode, the safety lever causes the EMFC 180 to be activated to control the computerized release of bullets according to a preprogrammed logic. To release a shot the EMFC 180 is activated to release stored energy to pull the EM sear 150 downward with the sear lever 162 thus releasing the hammer 110 (FIG. 7E).

In an embodiment of the disclosure, the preprogrammed logic may allow the release of bullets only when firearm sensors identify that a target will be hit. Alternatively, the preprogrammed logic may allow release of a first immediate shot and then only release bullets when they are deemed to hit the target or release bullets according to a time pattern, for example every 250 milliseconds or using some other pattern and/or conditions.

Figure 7F:
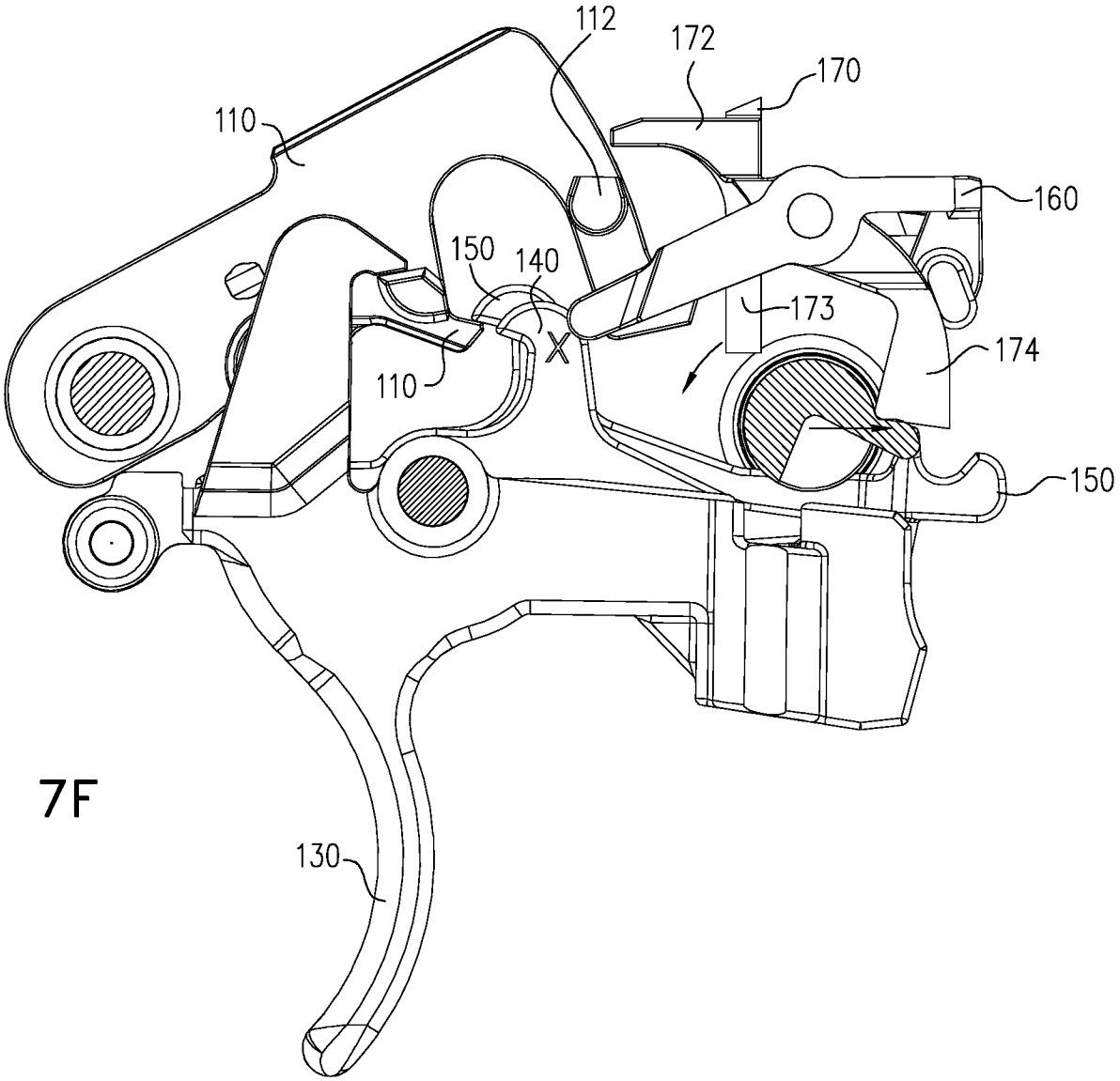
Figure 7G:
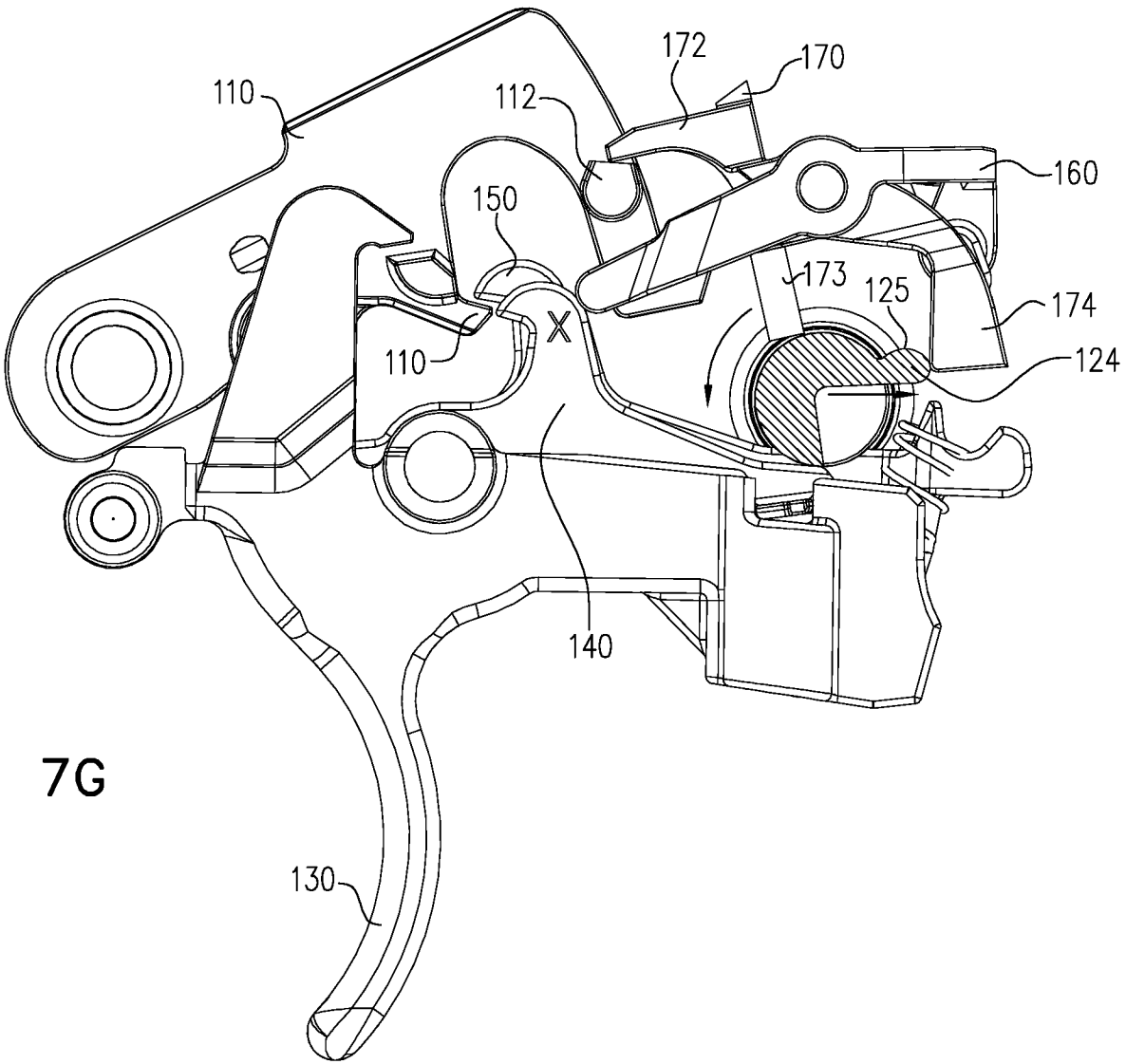
Figure 7H:
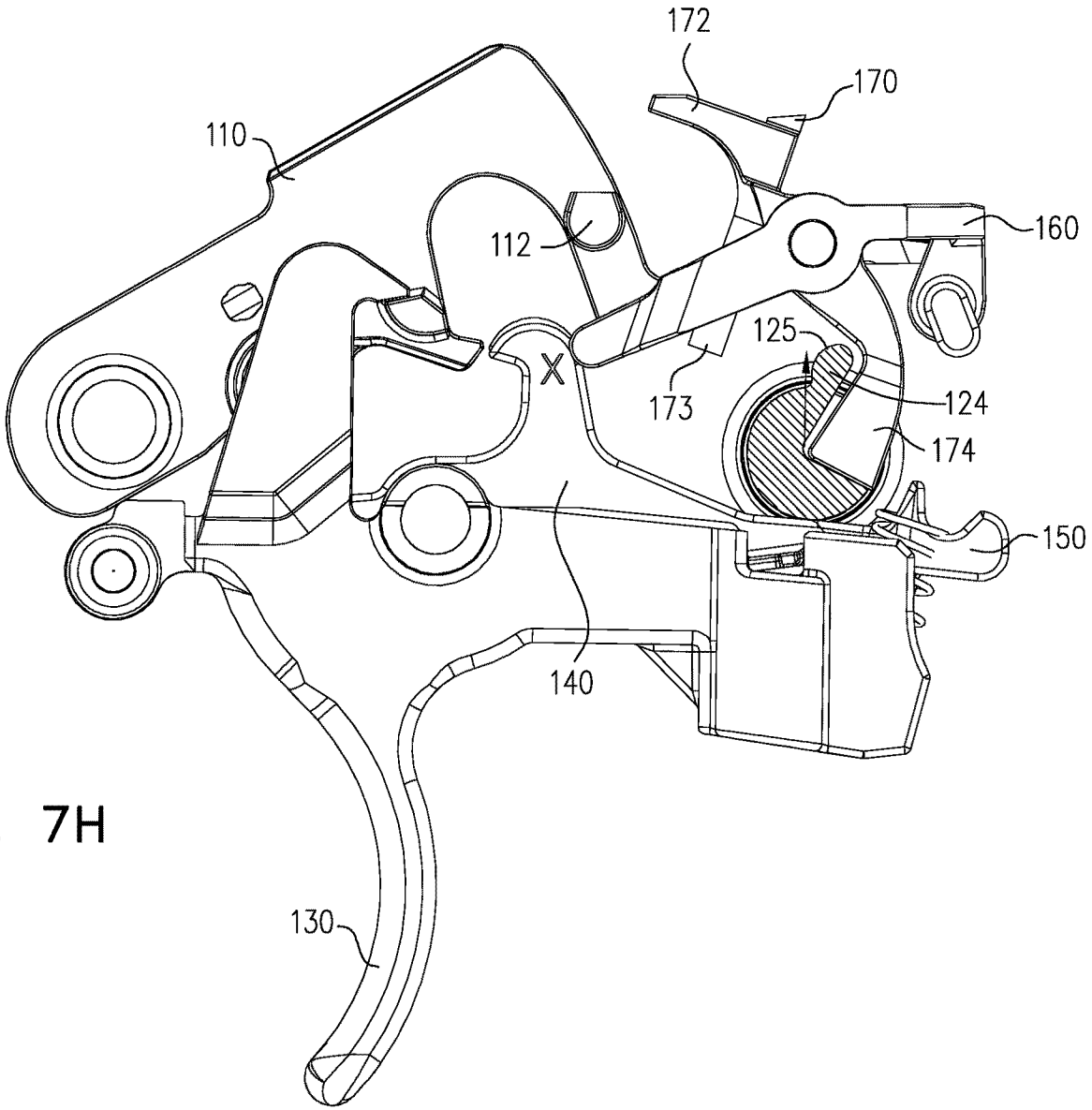

FIGS. 7F-7H show the reverse transition from EM mode to automatic mode. Initially the user releases the trigger 130 and the trigger 130 is positioned as a secondary safety block for motion of the hammer 110 (FIG. 7F). Then the user turns the safety lever 120 counterclockwise, causing the bulge lever 124 or contour 125 of the safety lever 120 to push the tail lever 174 of the hammer cocking sear 170 and rotate the hammer cocking sear 170 counterclockwise (FIG. 7G). The rotation pushes the head lever 172 of the hammer cocking sear 170 onto the hammer extrusion lever 112 so the hammer 110 is pressed down (FIG. 7G). Optionally, continuing to turn the safety lever 120 counterclockwise presses on the EM sear 150 to release the hammer 110 from the grasp of the EM sear 150. Further continuing to turn the safety lever 120 up to the auto mode position releases the hammer cocking sear 170 to turn back to a standby position. The hammer 110 slightly rises and is held by the trigger 130 to function in automatic mode (FIG. 7H).

In some embodiments of the disclosure, the firearm 100 may support other manual modes, for example burst mode. Alternatively, the firearm 100 may have fewer manual modes, for example only safe mode and more electromechanical (EM) modes or other combinations.

In some embodiments of the disclosure, safety lever 120 may be configured to rotate clockwise or counterclockwise to transition from EM mode to automatic mode or vice versa. Additionally, the order of the modes may be rearranged.

It should be appreciated that the above-described methods and apparatus may be varied in many ways, including omitting or adding elements or steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure.

It will be appreciated by persons skilled in the art that the present invention is not limited to what has been particularly shown and described hereinabove. Rather the scope of the present invention is defined only by the claims, which follow.

We claim:

1. A firearm, comprising:

a hammer;

a safety lever configured to select an operation mode;

a trigger;

an electromechanical sear;

wherein the operation modes include an electromechanical mode, and the firearm is configured so that when moving the safety lever to select the electromechanical mode the safety lever moves the hammer to be held by the electromechanical sear instead of by the trigger.

2. The firearm of claim 1, wherein the firearm is configured so that when changing the operation mode from the electromechanical mode to other modes the safety lever moves the hammer so that the hammer is released from the electromechanical sear and held by the trigger.

3. The firearm of claim 1, wherein the electromechanical mode is in addition to supporting mechanical modes that function without electrical power.

4. The firearm of claim 1, wherein the safety lever is configured to move the hammer with a set of levers; wherein the set of levers are coupled to the safety lever, the hammer and/or a hammer cocking sear.

5. The firearm of claim 1, wherein the firearm comprises a hammer cocking sear; wherein the hammer cocking sear includes a head lever and a tail lever; and wherein when moving the safety lever to the electromechanical mode, the safety lever pushes the tail lever of the hammer cocking sear and causes the head lever to lower the hammer to be held by the electromechanical sear instead of by the trigger.

6. The firearm of claim 5, wherein the firearm comprises an automatic mode sear that regulates firing in automatic mode; and wherein the automatic mode sear is coupled to the hammer cocking sear.

7. The firearm of claim 5, wherein the hammer includes an extrusion lever configured to be pushed by the head lever of the hammer cocking sear to lower the hammer.

8. The firearm of claim 5, wherein the safety lever includes a bulge lever configured to push the tail lever of the hammer cocking sear when changing to or from the electromechanical mode.

9. The firearm of claim 1, wherein the firearm comprises a semi-auto sear configured to hold the hammer immediately after releasing a first shot manually in a semi-automatic mode; and wherein the semi-auto sear is positioned in parallel to the electromechanical sear.

10. The firearm of claim 1, wherein the safety lever is configured to block motion of the electromechanical sear when not in use.

11. The firearm of claim 1, wherein the firearm comprises an electromechanical firing control (EMFC) configured to store mechanical energy and release shots responsive to decisions of a computer.

12. A method of activating a firearm in an electromechanical mode, comprising:

receiving a firearm comprising a hammer, a safety lever, a trigger and an electromechanical sear;

moving the safety lever to select an electromechanical mode;

wherein when moving the safety lever to select the electromechanical mode the safety lever moves the hammer to be held by the electromechanical sear instead of by the trigger.

13. The method of claim 12, wherein the firearm is configured so that when changing the operation mode from the electromechanical mode to other modes the safety lever moves the hammer so that the hammer is released from the electromechanical sear and held by the trigger.

14. The method of claim 12, wherein the safety lever moves the hammer with a set of levers; wherein the set of levers are coupled to the safety lever, the hammer and/or a hammer cocking sear.

15. The method of claim 12, wherein the firearm comprises a hammer cocking sear; wherein the hammer cocking sear includes a head lever and a tail lever; and wherein when moving the safety lever to the electromechanical mode, the safety lever pushes the tail lever of the hammer cocking sear and causes the head lever to lower the hammer to be held by the electromechanical sear instead of by the trigger.

* * * * *